US010240902B2

(12) United States Patent
Schlangen

(10) Patent No.: US 10,240,902 B2
(45) Date of Patent: Mar. 26, 2019

(54) STACKABLE ARCHERY TARGET HAVING MULTIPLE REPLACEABLE CUBE CORES

(71) Applicant: Jacob Schlangen, Avon, MN (US)

(72) Inventor: Jacob Schlangen, Avon, MN (US)

( * ) Notice: Subject to any disclaimer, the term of this patent is extended or adjusted under 35 U.S.C. 154(b) by 0 days.

(21) Appl. No.: 15/794,599

(22) Filed: Oct. 26, 2017

(65) Prior Publication Data

US 2018/0128581 A1 May 10, 2018

Related U.S. Application Data

(60) Provisional application No. 62/413,339, filed on Oct. 26, 2016.

(51) Int. Cl.
*F41J 3/00* (2006.01)

(52) U.S. Cl.
CPC ..... *F41J 3/0004* (2013.01); *A63B 2209/00* (2013.01); *A63B 2244/04* (2013.01)

(58) Field of Classification Search
CPC ..... F41J 3/00; F41J 3/04
USPC ..... 273/403, 407, 408
See application file for complete search history.

(56) References Cited

U.S. PATENT DOCUMENTS 4,066,261 A * 1/1978 Stewart ..... F41J 1/01 273/403
4,239,236 A * 12/1980 Parham ..... F41J 3/0004 273/403
4,294,452 A * 10/1981 Schlotter ..... F41J 13/00 273/403
6,068,261 A * 5/2000 Nettle ..... F41J 1/01 273/403
6,254,100 B1 * 7/2001 Rinehart ..... F41J 3/0004 273/403
6,983,939 B2 * 1/2006 Pulkrabek ..... F41J 3/0004 273/403
7,134,663 B1 * 11/2006 Lowe ..... F41J 3/0004 273/403
7,455,298 B1 * 11/2008 Nettle ..... F41J 3/0004 273/403
8,333,385 B2 * 12/2012 McGovern ..... F41J 3/0004 273/403
8,382,117 B1 * 2/2013 Harris ..... F41J 3/0004 273/403
2009/0134581 A1 * 5/2009 Box ..... F41J 3/0004 273/403

(Continued)

*Primary Examiner* — Mark Graham
(74) *Attorney, Agent, or Firm* — Vidas Arrett & Steinkraus P.A.

(57) ABSTRACT

The Stackable Archery Target Having Replaceable Cube Cores includes a plurality of replaceable cube cores, one or more core receivers. and a base. The base is formed with one or more core receivers, which receive one of more replaceable cube core. The replaceable cube core provides a visual target display for archers to aim and shoot The base ensures that the cube cores are firmly held within the confines of the core receiver to prevent the replaceable cube core from shifting or moving under impact from the arrows. The replaceable cube core is formed as a cube having three (3) useable target surfaces. Each target surface provides a consistent penetration depth on each surface for predictable results, regardless of the face that is used for the target surface. When one face has been sufficiently used, the user rotates the cube to show a fresh target display.

6 Claims, 9 Drawing Sheets

(56) References Cited

U.S. PATENT DOCUMENTS

| | | | | |
|---|---|---|---|---|
| 2011/0024986 | A1* | 2/2011 | Walker | F41J 1/01 273/403 |
| 2013/0270772 | A1* | 10/2013 | McGovern | F41J 3/0004 273/403 |
| 2015/0253115 | A1* | 9/2015 | Hartcraft | F41J 3/0004 273/403 |
| 2017/0167831 | A1* | 6/2017 | Schlangen | F41J 3/0004 |

* cited by examiner

STACKABLE ARCHERY TARGET HAVING MULTIPLE REPLACEABLE CUBE CORES

FIELD OF INVENTION

The present invention relates generally to archery accessories and more specifically to archery targets. The present invention is more particularly, but not exclusively, an archery target having multiple replaceable cores and capable of being used multiple times.

BACKGROUND OF THE INVENTION

Archery targets have been built historically using a straw material packaged into a particular target shape with a density sufficient to stop an arrow. Historically, a target having a high density of straw material was not able to be made due to the technology available at the time. In order to compensate for the lack of density, the straw material was packaged into large volume squares providing long distances that the arrow must penetrate to fully pierce the target. The long penetration distances provided by the large volume targets had enough friction to slow and stop an arrow. However, the targets were bulky, heavy, difficult to maneuver and transport.

With the advancement in technology, high density materials were made available for use in manufacturing archery targets. Many modern day targets are built using straw compacted to a higher density, layered foam materials, carpet, molded expanding foam materials, and various other materials. The advancement of materials allowed for archery targets to be made in smaller forms. This allowed for targets to be more portable and easier to handle. However, once the archery targets were used they would be discarded. The single uses of the archery targets were costly to the users.

Over the past twenty years, there has been a new category of archery target that has entered the market called 3D targets. These targets have the three dimensional shape of an animal and is formed with a removable core that can be replaced after the core is expended. The cores are placed at targeted areas on the target and are the only area on the 3D target aimed to be shot at. Once the core has reached its usability based upon the number of arrows shot into it, it is replaced thereby extending the life of the target These targets are expensive due to the molding and painting required to create the realistic representation of the animal when compared to a standard Block Style Target so the replacement of the removable core helps save cost. However, the cores are manufactured to only allow the core to be shot on two sides the back and front. Additionally, due to the real life size and shape associated with these 3D targets, many times the archery needs to place an additional target or bale of hay behind the 3D target just in case the archer misses the 3D Target adding cost and effort.

In light of the above, it would be advantageous to provide a low-cost target with a replaceable core. It would further be advantageous to provide a foam core having multiple target locations, each target location capable of having at least three (3) useable target surfaces. It would further be advantageous to provide a low-cost target with a replaceable core with the ability to withstand archery arrow impact without collapsing and a surface area large enough to catch stray arrows.

SUMMARY OF INVENTION

The Stackable Archery Target Having Replaceable Cube Cores of the present invention includes one or more replaceable cube cores and a base. The base houses one or more core receivers, which are cutouts formed into the base and capable of receiving multiple replaceable cube cores. The core receivers extend from the front of the base to the back of the base. The replaceable cube cores provide visual targets display for archers to aim and shoot The base ensures that the cube cores are firmly held within the confines of the core receiver and the base prevents the replaceable cube core from shifting or moving under impact from the arrows. The Stackable Archery Target Having Replaceable Cube Cores can also be stacked on top of each other and next to one another to create a target wall.

The replaceable cube core is formed as a cube having three (3) useable target surfaces. Due to the cube shape, each target surface provides a consistent penetration depth on each surface for predictable results, regardless of the face that is used for the target surface. Depending on the depth of the target base, multiple replaceable cube cores are stacked next to one another and received by the core receiver of the base. The expandable foam of the replaceable cube core prevents the replaceable cube core from shifting or moving when impacted by arrows.

In an alternative embodiment, instead of having only multiple replaceable cube cores within the core receivers, other arrangements may be made. For a non-limiting example, two (2) replaceable cube cores may be positioned on either end of a replaceable filler. The replaceable filler has no target faces and does not need to be rotated between uses.

A single Stackable Archery Target Having Replaceable Cube Cores can be shot at from both sides (back and front), allowing the user to utilize the target in multiple ways. In addition, because the Stackable Archery Target Having Replaceable Cube Cores can have a plurality of core receivers, the user can target different areas without having to move the Stackable Archery Target Having Replaceable Cube Cores or rotate the replaceable cube cores after every shot.

Multiple Stackable Archery Target Having Replaceable Cube Cores may be placed upon one another. As a non-limiting example, the user may place multiple bases against the wall in order to create a wall of Stackable Archery Target HavingReplaceable Cube Cores.

In an alternative embodiment of the present invention, the base includes a groove along the perimeter of the base, which allows multiple Stackable Archery Target Having Replaceable Cube Cores to be tied together when stacked to prevent movement when impacted by arrows. Using this embodiment allows the user to create a more stable wall of Stackable Archery Target Having Replaceable Cube Cores.

In another alternative embodiment of the Stackable Archery Target Having Multiple Replaceable Cube Cores Referring, the base has two (2) replaceable panels and the base midsection. The two (2) replaceable panels are identical square prisms. having four (4) peripheral sides, a front side, and a back side. Between the replaceable panels is a base midsection. The base midsection is also a square prism with four (4) peripheral sides, a front side, and back side. The front side of the base midsection is directly adjacent to the back side of one (1) replaceable panel, and the back side of the base midsection is directly adjacent to the back side of the other replaceable panel As with other embodiments, this embodiment is stackable using two (2) or more alternative embodiments of the Stackable Archery Target Having Multiple Replaceable Cube Cores.

Each of the replaceable panels have one (1) or more cutouts which correspond to cutouts in the midsection. When assembled, these cutouts form a core receiver. The core receivers are configured to receive one or more replaceable cube cores, as described above. As with previous embodiments described above, the shape of the assembled core receiver corresponds with the shape of the replaceable cube cores. Thus, the replaceable cube core is dependent on the size and shape of the core receiver and vice versa.

In order to attach the base midsection to the back side of each of the two (2) replaceable panels, two Velcro® strips are located on the front side and back side of the base midsection. The Velcro® strips on the base midsection correspond to two (2) Velcro® strips positioned on the back side of each replaceable panel.

In this embodiment, the replaceable cube cores can be rotated within the core receiver. Furthermore, as the user shoots at the alternative embodiment of the Stackable Archery Target Having Multiple Replaceable Cube Cores with arrows, the replaceable panels will be hit with stray arrows. In order to present the user with a fresh target surface and surrounding area, the user may replace the replaceable panels without needing to replace the base midsection, thereby extending the life of the target.

In yet another alternative embodiment, the Stackable Archery Target Having Replaceable Cube Cores includes a base having two (2) target frames and a replaceable midsection formed to receive one (1) or more replaceable cube cores. The target frames are identical square prisms. having four (4) peripheral sides with a width, a front side, a back side, and a midsection cutout. The midsection cutout is formed to receive the replaceable midsection. The replaceable midsection has four (4) peripheral sides, a front side, a back side, and is formed with one (1) or more core receivers. A core receiver is a continuous cutout or tunnel that extends from the front side of the replaceable midsection to the back side of the replaceable midsection. The core receivers are configured to receive one or more replaceable cube cores.

In this embodiment, the replaceable cube cores can be rotated within the core receiver as described above. Furthermore, as the user shoots at the Archery Target with arrows, the replaceable midsection will become used from being hit with stray arrows. In order to present the user with a fresh target surface and surrounding area, the user may replace the replaceable midsection without needing to replace the target frames. Since the target frame represents an area of the Archery Target that is least likely to be hit by stray arrows, this embodiment allows the user to replace the replaceable midsection without having to replace the target frames.

In another embodiment, the Archery Target Having Multiple Replaceable Cube has an additional groove formed in the four (4) peripheral sides of the each of the replaceable panels or on the four (4) peripheral sides of the target frames. The grooves can vary in depth and width depending on the desires of the user. The purpose of the grooves is to allow the user to secure the alternative embodiments of the Stackable Archery Target Having Multiple Replaceable Cube Cores with a rope or string when multiple Archery Targets are positioned next to or on top of one another.

BRIEF DESCRIPTION OF THE FIGURES

The objects, features, and advantages of the apparatus according to the invention will be more clearly perceived from the following detailed description, when read in conjunction with the accompanying drawing, in which.

DETAILED DESCRIPTION OF THE INVENTION

Figure 1:
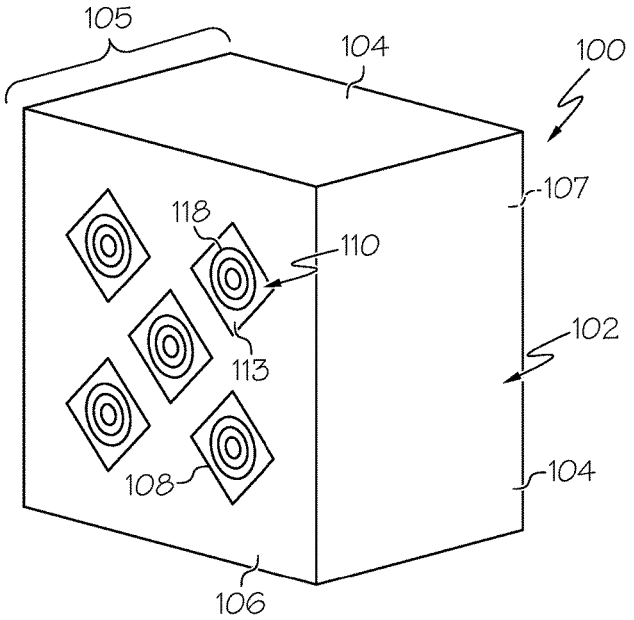
FIG. 1 is a front perspective view of the Stackable Archery Target Having Replaceable Cube Cores of the present invention, showing the replaceable cube cores within five (5) core receivers formed into the base.

Referring initially to FIG. 1, a preferred embodiment of the present invention, the Stackable Archery Target Having Replaceable Cube Cores, is shown and generally designated 100. The Stackable Archery Target Having Replaceable Cube Cores 100 (hereinafter referred to as "Archery Target 100"), described in conjunction with FIGS. 2-6, includes a base 102 formed with one or more core receivers 108 formed to receive one or more replaceable cube cores 110.

The base 102 is square prism and can vary in size depending on the use of the Archery Target 100. While shown as a square prism, the shape of base 102 can vary without deviating from the scope of the present invention. Possible shapes include, but are not limited to, diamond, triangle, circular, rectangular, etc, and the base 102 depiction as a square prism is not meant to be limiting. However, if the user wishes to stack the base 102 of the Archery Target 100 of the present invention, the base 102 would have to be a suitable shape to do so.

Base 102 is constructed from a high-density polyurethane foam material with a formulation of a two-part expanding foam that is self-sealing with excellent stopping properties. In a preferred embodiment, the base 102 is made of a material having a lower density than the replaceable cube core 110 (subsequently described in FIG. 4). The base 102 surrounds the replaceable cube core 200, eliminating the need to have tertiary support.

Base 102 has four (4) peripheral sides 104 with a width 105, a front side 106, and a back side 107. The base 102 is formed with one (1) or more core receivers 108, which are cutouts or tunnels that extend from the front side 106 to the back side 107 of base 102. The core receivers 108 are configured to receive one or more replaceable cube cores 110. Each replaceable cube core 110 has one (1) visual target displays 118 of each target face 113, 114, 115, (Shown in FIGS. 1, 4, and 5) for archers to aim and shoot, which will be discussed in further detail in subsequent Figures.

Figure 2:
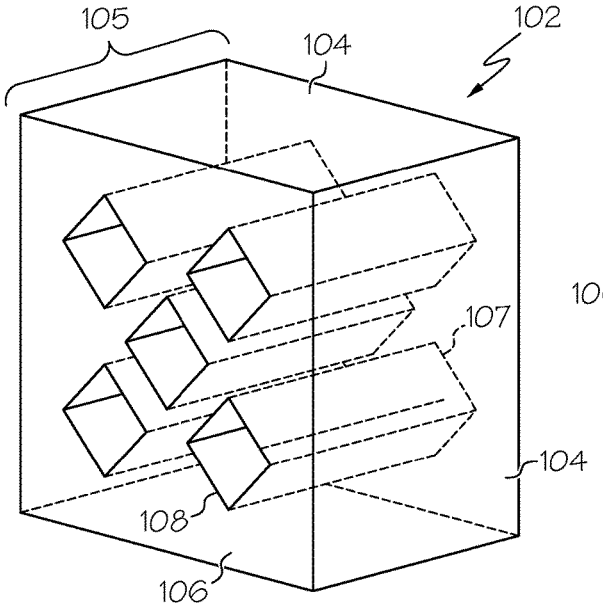
FIG. 2 is a front perspective view of the base of the Stackable Archery Target Having Replaceable Cube Cores, showing five (5) core receivers in dashed lines and without any replaceable cube cores.
Figure 3:
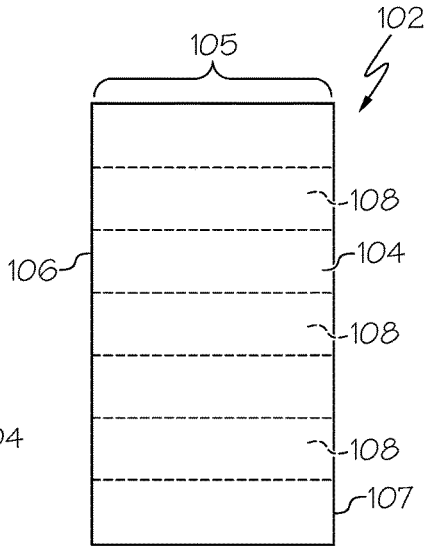
FIG. 3 is a side view of the base of the Stackable Archery Target Having Replaceable Cube Cores, showing the core receivers in dashed lines.

Looking now at FIGS. 2 and 3, the base 102 is shown without any replaceable cube cores 110 located within the five (5) core receivers 108. As shown by the Figures, the base 102 is formed with one (1) or more core receivers 108. The shape of the core receiver 108 corresponds with the shape of the replaceable cube cores 110, allowing one (1) target face 113,114,116 (Shown in FIGS. 1, 4, and 5) to be shown on the front side 106 and the back side 107 of base 102.

The core receivers 108 extend the width 105 of base 102; from the front side 106 to the back side 107, as indicated by dashed lines in FIGS. 2 and 3. The core receivers 108 of base 102 ensure that the replaceable cube cores 110 are firmly held within the confines of the core receiver 110 to prevent the replaceable cube cores 100 from shifting or moving under impact from the arrows. While depicted in FIGS. 1, 2, and 6 as having five (5) core receivers 108, it will be understood by those skilled in the art, that one (1) or more core receivers 108 may be used and may be located at any location on the base 102 of Archery Target 100 and in any pattern, depending on the desires of the user.

Figure 4:
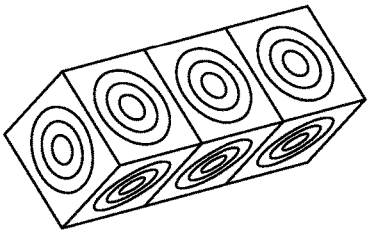
FIG. 4 is a front perspective view of 3 (three) replaceable cube cores arranged next to one another as they would be within a core receiver.

In FIG. 4, three (3) replaceable cube cores 110 positioned immediately adjacent to one another are shown. This arrangement depicts one example of how multiple replaceable cube cores 110 may be arranged in the core receivers 108. Each replaceable cube core 110 is a cube having equal dimensions for its width, height, and length. By having equal dimensions, the replaceable cube core 110 provides an arrow a consistent penetration depth for predictable results, regardless of the face that is used for the target surface. In a preferred embodiment, the replaceable cube core 110 is 8" by 8" by 8", however the size of the replaceable cube core 110 may be scaled to size for appropriate uses. The shape and size of the replaceable cube core 110 is dependent on the size of the core receiver 108 formed into the base 102. Thus, the replaceable cube core 110 is dependent on the size and shape of the core receiver 108 and vice versa.

In a preferred embodiment, the replaceable cube core 110 is made from a high-density polyurethane foam material with a formulation of a two-part expanding foam that is self-sealing with excellent stopping properties. Once placed inside the core receivers 108, the replaceable cube cores 110 expand to prevent the replaceable cube cores 110 from moving during impact.

As stated above, while the replaceable cube cores 110 are described as being cube-shaped and having a total of six (6) faces 113-116, one of ordinary skill in the art would appreciate that any shape may be used without deviating from the scope and spirit of the invention. In addition, any face of the replaceable cube core 110 may have a visual target display 118, or may have no visual target display whatsoever, depending on the use of the Archery Target 100. For example, all faces of the replaceable cube core 110 may have a visual target display 118 without deviating from the scope and spirit of the invention.

The faces 113-116 of the replaceable cube cores 110 may be any color or design. For example, instead of the visual target display 118, the replaceable cube cores 110 may be a specific color or have a certain design other than that of the visual target display 118. In addition, the core receiver(s) 108 may be a different color than the replaceable cube cores 110 to further outline and distinguish the target for the user. In yet another example, the base 102 of the Archery Target 100 may also have a color or design that distinguishes the replaceable cube cores 110 from the base 102 itself.

Figure 5:
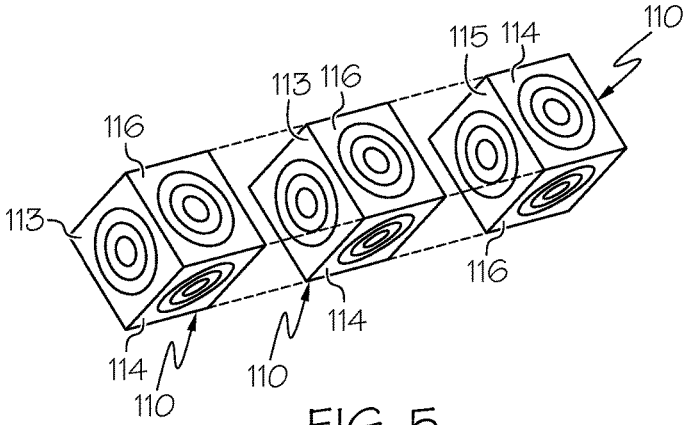
FIG. 5 is an exploded front perspective view of three (3) replaceable cube cores arranged next to one another as they would be within a core receiver.

FIG. 5 is an exploded view of the three (3) replaceable cube cores 110 shown in FIG. 4. As shown in FIG. 5, the replaceable cube cores 110 have three (3) faces 113, 114, and 116 with a visual target display 118 printed on them. The remainder of the faces may be blank faces 115.

Figure 6:
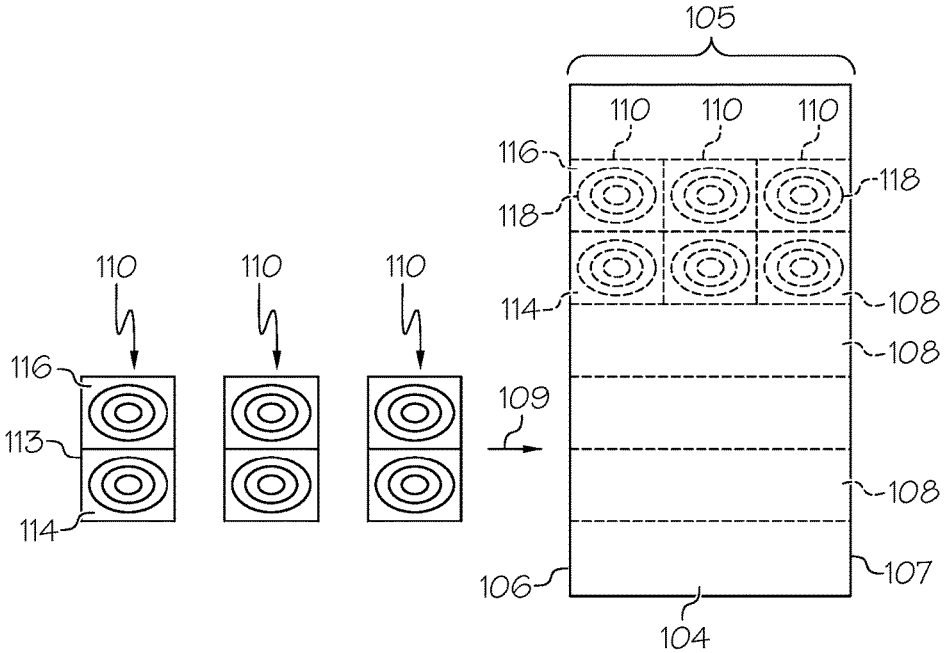
FIG. 6 is a side view of the Stackable Archery Target Having Replaceable Cube Cores of the present invention, showing three (3) replaceable cube cores in one (1) core receiver and the placement of three (3) core receivers in another core receiver in the direction indicated by the arrow.

A side view of the Archery Target 100 of the present invention is shown in FIG. 6. To use, the user places one or more replaceable cube cores 110 in a core receiver 108. In FIG. 6, three (3) replaceable cube cores 110 are shown in dashed lines within a core receiver 108 and three (3) replaceable cube cores 110 are shown being placed within the core receiver 108 in direction 109. As stated above, the amount of replaceable cube cores 110 stacked together within the core receiver 108 will depend on the width 105 of the base 102 and the number of replaceable cube cores 110.

Once the replaceable cube core 110 has reached its usability based upon the number of arrows penetrated through its core, it is rotated in order to expose a new target face 113, 114, 116, to the user. For example and as shown in FIGS. 1 and 6, when the replaceable cube cores 110 are placed inside a core receiver 108, target face one 112 may be visible from the front side 106 of the base 102. Target face one 112 of another replaceable cube core 110 is shown from the back side 107 of base 102. Thus two (2) target displays 118 are visible from two (2) sides of the base 102.

After the target has been sufficiently used, the end replaceable cube cores 110 can be rotated to show target face two 114, assuming the user wishes to use both the front side 106 and back side 107. When target face two 114 is sufficiently used, the end replaceable cube cores 110 are rotated to show target face three 116 to the user. When target face three 116 is used, the cubes can be discarded. Thus, in comparison with the prior art currently available, the Archery Target 100 can be used at least three (3) times when the replaceable cube core 110 is in cube form.

As the replaceable cube core 110 has six (6) possible faces 113-116, the user may choose to rotate tile replaceable cube core 110 an additional three (3) times in the manner described above.

Figure 7:
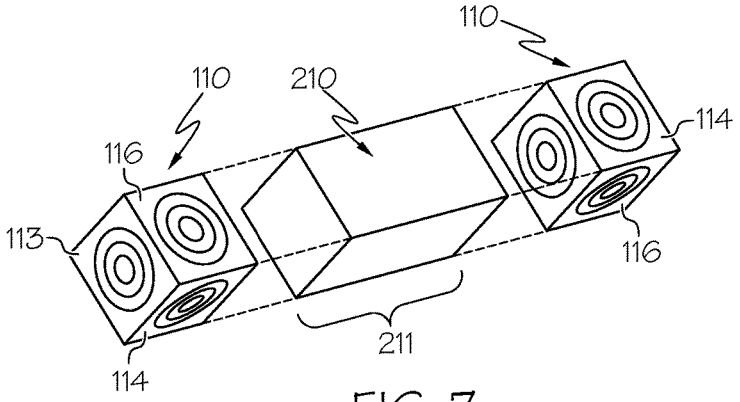
FIG. 7 is a front perspective view of an alternative arrangement of the core receivers, including two {2) core receivers and a replaceable filler.

FIG. 7 depicts an alternative embodiment of a potential replaceable cube core 110 and replaceable filler 210 combination. In this embodiment, instead of placing multiple replaceable cube cores 110 within the core receiver 108 next to one another, the user can use a replaceable filler 210 in place of one or more replaceable cube cores 110. The replaceable filler 210 has a length 211 which would be dependent on the width 105 of the base 102, as well as the number of replaceable cube cores 110 used. As a non-limiting example, assume the width 105 of base 102 is equivalent to five (5) replaceable cube cores 110. Instead of placing five (5) replaceable cube cores 110 within a core receiver 108, a user can place two (2) replaceable cube cores 110 on either end of a replaceable filler 210. The replaceable filler 210 would have a length 211 equivalent to three (3) replaceable cube cores 110. This would cut the cost of using five (5) replaceable cube cores 110 to only using two (2) replaceable cube cores 110. Thus, the two (2) replaceable cube cores 110 can be rotated and replaced without having to rotate and replace the replaceable filler 210. However, when sufficiently used, the replaceable filler 210, may also be replaced. However, as the replaceable filler 210 does not need a clean target face 113, 114, and 115, the replaceable filler 210 can be replaced less frequently than the replaceable cube cores 110.

Alternatively, the user may wish to have replaceable cube cores 110 that are longer in length. Thus, a replaceable filler 210 with a visual target display 118 is fully contemplated.

Figure 8:
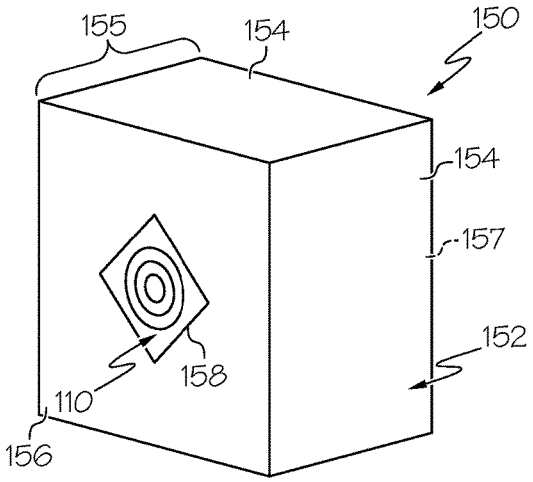
FIG. 8 is a front perspective view of an alternative embodiment of the Stackable Archery Target Having Replaceable Cube Cores of the present invention, showing the base, and one (1) replaceable cube core within one (1) core receiver.

FIG. 8, an alternative embodiment of the Archery Target 100 is shown and generally labeled 150. The alternative embodiment of the Archery Target 150 of the present invention shows an archery target base 152 smaller in size to the base 102 of Archery Target 100 depicted, for example, in FIG. 1. Target base 152 has a front side 156, a back side 157, four (4) peripheral sides 154 and a width 155. This embodiment also depicts one (1) replaceable cube core 110 located within one (1) core receiver 158 formed into base 152. As stated above, the Archery Target 100 can have one (1) or more core receivers 108. FIG. 1, for example, shows Archery Target 100 with five (5) core receivers 108. Archery Target 158 depicting one (1) core receiver 158 is one, non-limiting example of potential embodiments that are contemplated by this disclosure.

Figure 9:
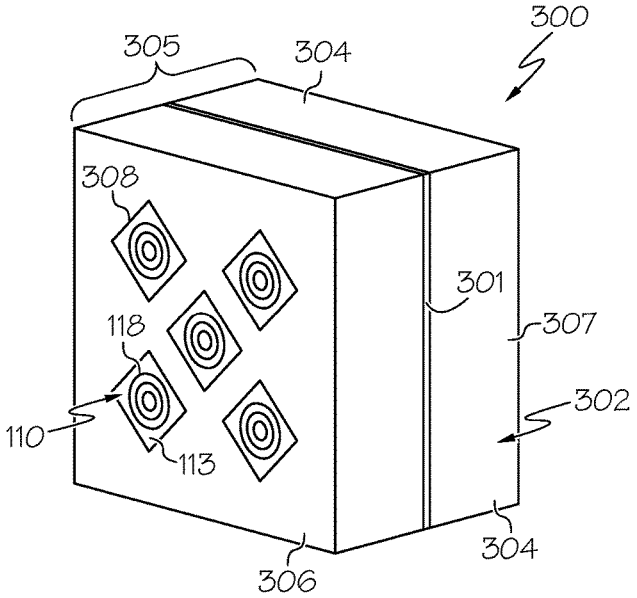
FIG. 9 is a front perspective view of an alternative embodiment of the Stackable Archery Target Having Replaceable Cube Cores of the present invention, showing the replaceable cube cores within the core receivers formed into the base and including a groove located on the peripheral sides of the base.

In FIG. 9, an alternative embodiment of the Archery Target Having Multiple Replaceable Cube Cores is shown and generally designated 300 (hereafter referred to as "Archery Target 300"). As with the previous embodiment (Archery Target 100, shown in FIG. 1), the Archery Target 300 includes a base 302 formed with one or more core receivers 308 configured to receive one or more replaceable cube cores 110.

The base 302 has four (4) peripheral sides 304 with a width 305, a front side 306, and a back side 307. The base 302 is formed with one or more core receivers 308, which are cutouts or tunnels that extend from the front side 306 to the back side 307 of base 302. The core receivers 308 are configured to receive one or more replaceable cube cores 110. While depicted in FIGS. 9 and 10 as having five (5) core receivers 308 formed into each base 302, it will be understood by those skilled in the art, that one (1) or more core receivers 308 may be used and may be located at any location on the base 302 of Archery Target 300 and in any pattern, depending on the desires of the user, without deviating from the scope and spirit of the invention.

The four (4) peripheral sides 304 of the Archery Target 300 are formed with a groove 301. The groove 301 can vary in depth and width depending on the desires of the user. The purpose of the groove 301 is to allow the user to secure the Archery Targets 300 when multiple Archery Targets 300 are positioned next to or on top of one another.

Figure 10:
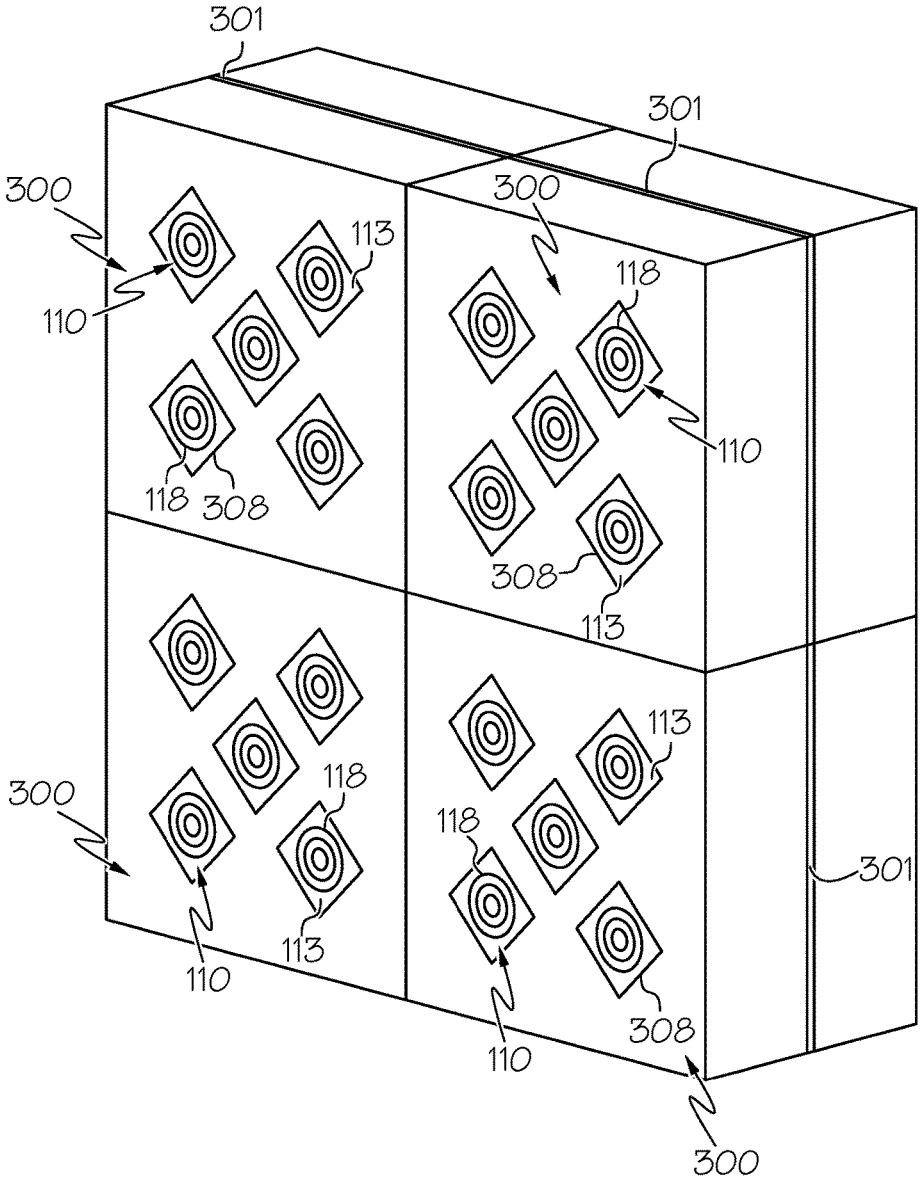
FIG. 10 is a front perspective view of multiple alternative embodiments of the Stackable Archery Target Having Replaceable Cube Cores of the present invention stacked upon one another.

As with the previous embodiment, the Archery Target 300 can be stacked on or place next to, one another to create a larger structure of Archery Targets 300, as shown in FIG. 10. When two (2) or more Archery Targets 300 are connected to one another, it may be difficult to prevent the Archery Target 300 from moving when struck with an arrow. Thus, the groove 301, allows the user to place a rope, ribbon, string, chain, or other securing means around the peripheral sides 304 of multiple Archery Targets 300 by placing the rope, ribbon, string, chain, or other securing means within the groove 301; effectively securing the Archery Targets 300 to one another.

Figure 11:
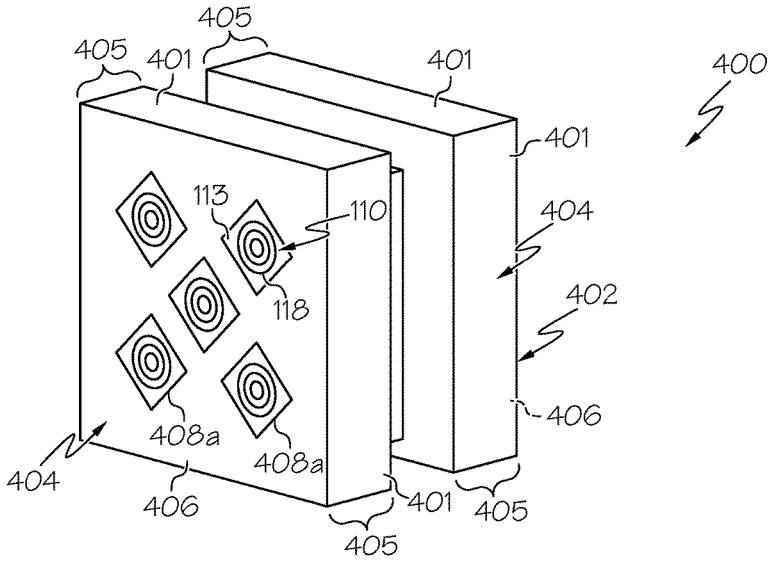
FIG. 11 is a front perspective view of an alternative embodiment of the Stackable Archery Target Having Replaceable Cube Cores of the present invention, showing the base with two (2) replaceable panels and replaceable cube cores.

Referring now to FIG. 11, a perspective view of the alternative embodiment of the Stackable Archery Target Having Replaceable Cube Cores of the present invention is shown and generally designated 400. The alternative embodiment of the Stackable Archery Target Having Replaceable Cube Cores 400 (hereinafter referred to as "Archery Target 400"), described in conjunction with FIGS. 11-16, includes a base 402 formed to receive one or more replaceable cube cores 110. The replaceable cube cores 110 are depicted in FIG. 11 showing target face one 113 with the visual target display 118.

Figure 12:
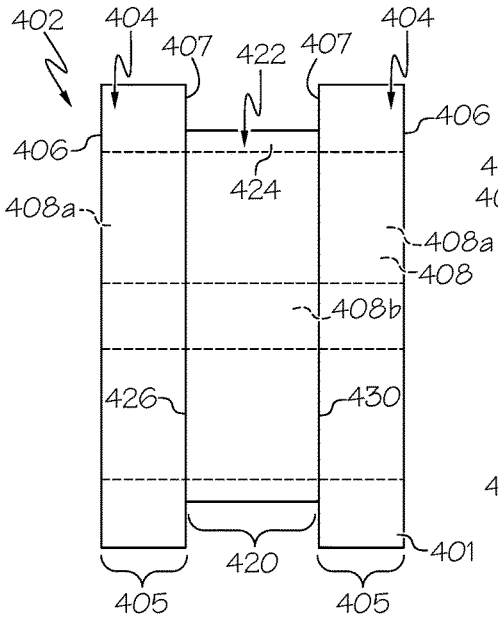
FIG. 12 is a side view of the base of the alternative embodiment of the Stackable Archery Target Having Replaceable Cube Cores of the present invention, showing two (2) replaceable panels and base midsection, with core receivers shown in dashed lines.

The base 402 has two (2) replaceable panels 404 and a base midsection 422 (shown in FIG. 12). The two (2) replaceable panels 404 are identical square prisms, having four (4) peripheral sides 401 with a width 405, a front side 406, a back side 407, and cutouts 408*a*.

While shown as a square prism, the shape of the replaceable panels 404 can vary without deviating from the scope of the present invention. Possible shapes include, but are not limited to, diamond, triangle, circular, rectangular, etc., and the depiction as a square prism is not meant to be limiting. However, if the user wishes to stack several Archery Targets 400 together, the replaceable panels 404 would have to be a suitable shape to do so.

Base 402, including the replaceable panels 404 and base midsection 422, is constructed from a high-density polyurethane foam material with a formulation of a two-part expanding foam that is self-sealing with excellent stopping properties. In a preferred embodiment, the base 402 is made of a material having a lower density than the replaceable cube cores 110. The base 402 surrounds the replaceable cube cores 110, eliminating the need to have tertiary support.

Figure 13:
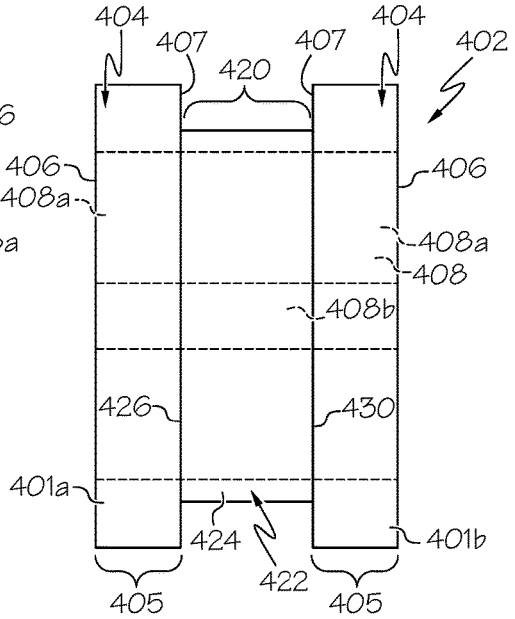
FIG. 13 is a top view of the base of the alternative embodiment of the Stackable Archery Target Having Replaceable Cube Cores of the present invention, showing two (2) replaceable panels and base midsection, with core receivers shown in dashed lines.

Between the two (2) replaceable panels 404 is the base midsection 422, as shown in FIGS. 12 and 13. Midsection 422 has four (4) peripheral sides 424 with a width of 420, a front side 426, and back side 430. FIG. 12 is the side view of the Archery Target 400 of the present invention, and FIG. 13 is the top view of the Archery Target 400. As shown by these Figures, the base midsection 422 is smaller in length and height than the replaceable panels 404. The front side 426 of the base midsection 422 is directly adjacent to the back side 407 of one (1) replaceable panel 404, and the back side 430 of the base midsection 422 is directly adjacent to the back side 407 of the other replaceable panel 404.

While the base midsection 422 is shown in FIGS. 12 and 13 as being smaller in length and height than the replaceable panels 404, a base midsection 422 with an equal length and height to the replaceable panels 404 is fully contemplated by this disclosure and would not deviate from the scope and spirit of the invention.

Each of the replaceable panels 404, as well as the base midsection 422, are formed with one (1) or more cutouts 408*a* and 408*b*, respectively, that form one (1) or more core receivers 408 when the base 402 is assembled. Described in another way, cutouts 408*a* and 408*b* collectively form the core receiver 408 when base 402 is assembled. The core receiver 408 is a continuous cutout or tunnel from the front side 406 of one replaceable panel 404 to the front side 406 of the other replaceable panel 404, through the base midsection 422. The core receivers 408 are configured to receive one or more replaceable cube cores 110 as described above. As with previous embodiments described above, the shape of the assembled core receiver 408 corresponds with the shape of the replaceable cube cores 110. Thus, the replaceable cube core 110 is dependent on the size and shape of the core receiver 408 and vice versa.

In addition, although five (5) core receivers 408 are shown in FIG. 11, it will be understood by those skilled in the art, that one (1) or more core receivers 408 may be used and may be located at any location on the base 402 of Archery Target 400 and in any pattern, depending on the desires of the user.

Figure 14:
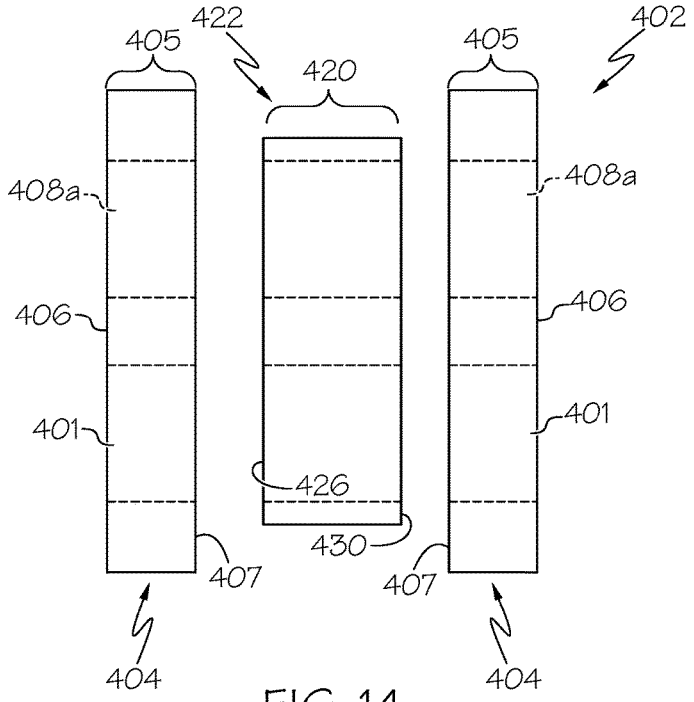
FIG. 14 is an exploded side view of the base of the alternative embodiment of the Stackable Archery Target Having Replaceable Cube Cores, showing two (2) replaceable panels and base midsection, with cutouts that are assembled to form the core receivers shown in dashed lines.

FIG. 14 is an exploded side view of the base of the alternative embodiment of the Archery Target 400. In this Figure, the two replaceable panels 404 and base midsection 422 are depicted in order to better show how they are arranged together to form base 402 of the Archery Target 400.

Figure 15:
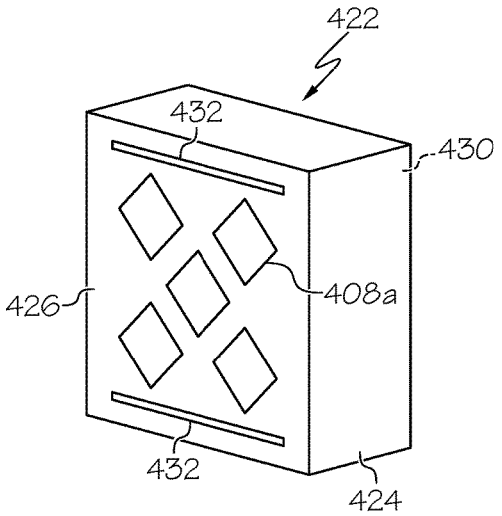
FIG. 15 is a front perspective view of the base midsection of the alternative embodiment of the Stackable Archery Target Having Replaceable Cube Cores of the present invention, showing a front side, peripheral sides, five (5) cutouts, and two (2) Velcro® strips.
Figure 16:
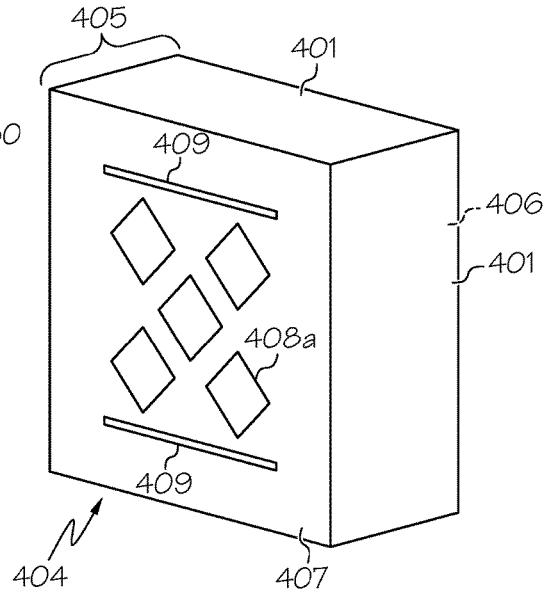
FIG. 16 is a back perspective view of one (1) replaceable panel of the alternative embodiment of the Stackable Archery Target Having Replaceable Cube Cores of the present invention, showing the back side, peripheral sides, five (5) cutouts, and two (2) Velcro® strips.

FIG. 15 is a front perspective view of the base midsection 422 of the base 402 of the Archery Target 400. As stated above, five (5) cutouts 408*b* are formed into the base midsection 422. and extend from the front side 426 to the back side 430 of the base midsection 422.

In order to attach the base midsection 422 to the back side 407 of each of the two (2) replaceable panels 404, two Velcro® strips 432 are located on the front side 426 and back side 430 of base midsection 422. The Velcro® strips 432 on base midsection 422 correspond to two (2) Velcro® strips 409 positioned on the back side 407 of each replaceable panel 404.

Looking now at FIG. 14, the back perspective view of one (1) replaceable panel 404 is shown. As with the base midsection 422. each replaceable panel 404 is formed with five (5) cutouts 408*a* that extend from the front side 406 to the back side 407 of the replaceable panel 404. Two (2) Velcro strips 409 are located above and below the cutouts 408*a* on the back side 407, and are used to attach the replaceable panels 404 to the base midsection 422.

To assemble the Archery Target 400, the user would attach the back side 407 of one (1) replaceable panel 404 to the front side 426 of base midsection 422 using the corresponding Velcro® strips 409,432 located on the replaceable panel 404 and base midsection 422, respectively. The back side 407 of the second replaceable panel 404 is then attached to the back side 430 of base midsection 422 using the corresponding Velcro® strips 409,432 located on the replaceable panel 404 and base midsection 422, respectively. As stated above, the cutouts 408*b* of the base midsection 422 and the cutouts 408*a* of the replaceable panels 404 correspond to one another, and when the base 402 is assembled, form a core receiver 408. One (1) or more replaceable cube cores 110 or combinations of replaceable cube cores 110 and replaceable fillers 210 are placed inside the core receiver 408 depending on the combined width 405 and 420 of the replaceable panels 404 and base midsection 422.

Although the method of attaching the replaceable panels 404 to the base midsection 422 is Velcro® strips 409, 432, it is to be appreciate by one skilled in the art that other methods of attaching may be used, including, but not limited to, ties, adhesives, hooks, etc.

In this embodiment, the replaceable cube cores 110 can be rotated within the core receiver 408 as described above. Furthermore, as the user shoots at the Archery Target 400 with arrows, the replaceable panels 404 will be hit with stray arrows, causing it to become worn. In order to present the user with a fresh target surface and surrounding area, the user may replace the replaceable panels 404 without needing to replace the base midsection 422, which is not visible to the user.

Figure 17:
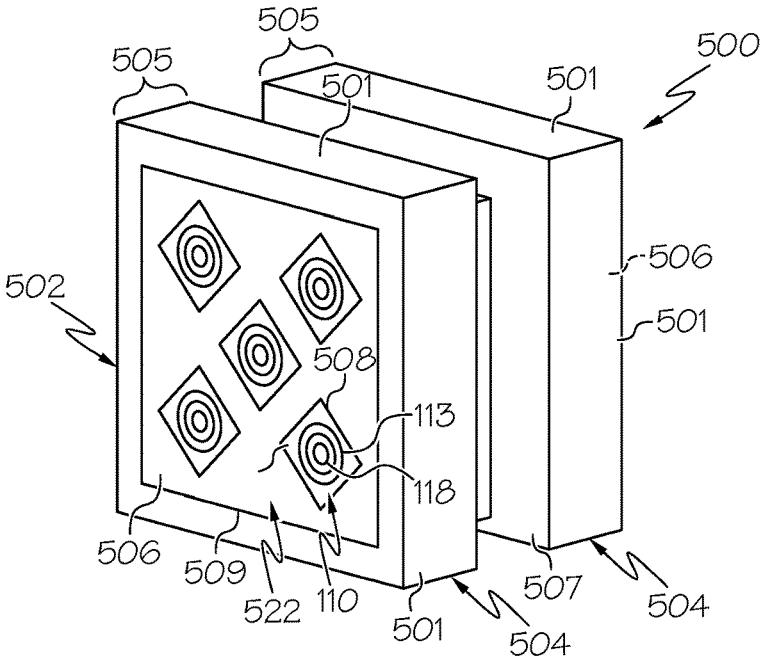
FIG. 17 is a front perspective view of an alternative embodiment of the Stackable Archery Target Having Replaceable Cube Cores of the present invention, showing the base and replaceable cube cores.

Referring now to FIG. 17, a perspective view of an alternative embodiment of the Stackable Archery Target Having Replaceable Cube Cores of the present invention is shown and generally designated 500. The alternative embodiment of the Stackable Archery Target Having Replaceable Cube Cores 500 (hereinafter referred to as "Archery Target 500"), described in conjunction with FIGS. 17-20, includes a base 502 having two (2) target frames 504 and a replaceable midsection 522 formed to receive one or more replaceable cube cores 110. The replaceable cube cores 110 are depicted in FIG. 17 showing target face one 113 with the visual target display 118.

As stated above, the base 502 has two (2) target frames 504 and the replaceable midsection 522. The two (2) target frames 504 are identical square prisms, having four (4) peripheral sides 501 with a width 505, a front side 506, a back side 507, and a midsection cutout 509.

While shown as a square prism, the shape of the target frame 504 can vary without deviating from the scope of the present invention. Possible shapes include, but are not limited to, diamond, triangle, circular, rectangular, etc., and the depiction as a square prism is not meant to be limiting. However, if the user wishes to stack several Archery Targets 500 together, the target frames 504 would have to be a suitable shape to do so.

Base 502, including the target frames 504 and replaceable midsection 522, is constructed from a high-density polyurethane foam material with a formulation of a two-part expanding foam that is self-sealing with excellent stopping properties. In a preferred embodiment, the base 502 is made of a material having a lower density than the replaceable cube cores 110. The base 502 surrounds the replaceable cube core 110, eliminating the need to have tertiary support.

Figure 18:
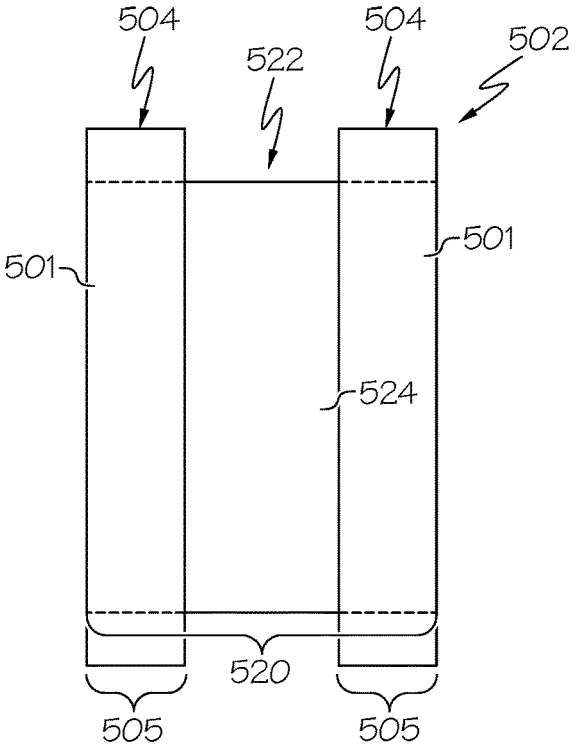
FIG. 18 is a side view of the base of the alternative embodiment of the Stackable Archery Target Having Replaceable Cube Cores of the present invention, showing two (2) target borders, and replaceable midsection.

The midsection cutout 509 is formed to receive the replaceable midsection 522, as shown in FIGS. 17-18. Replaceable midsection 522 has four (4) peripheral sides 524 with a width 520, a front side 526, and back side 530. FIG. 18 is the side view of the Archery Target 500 of the present invention. As shown by FIG. 18, the replaceable midsection 522 is smaller in length and height than the target frames 504. The dashed lines in FIG. 18 represent the peripheral side 524 of the replaceable midsection 522 not visible when replaceable midsection 522 is inserted into the target frames 504.

Figure 19:
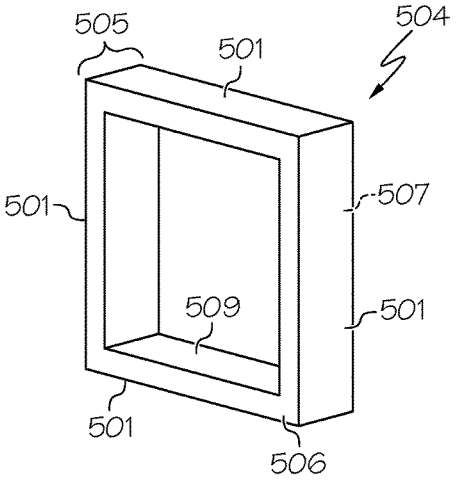
FIG. 19 is a front perspective view of one (1) target border of the alternative embodiment of the Stackable Archery Target Having Replaceable Cube Cores of the present invention, showing a front side, peripheral sides, and midsection cutout.

In FIG. 19, one (1) target frame 504 is shown by itself for clarification. In this Figure (as well as in FIG. 17), a square midsection cutout 509 is shown. While shown as a square, the midsection cutout 509 may be any shape depending on the shape of the replaceable midsection 522 that the midsection cutout 509 is configured to receive.

Figure 20:
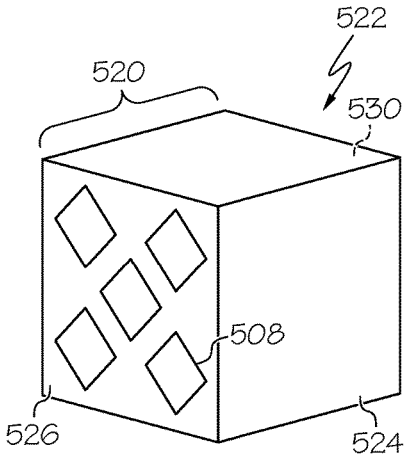
FIG. 20 is a front perspective view of the replaceable midsection of the alternative embodiment of the Stackable Archery Target Having Replaceable Cube Cores of the present invention, showing the replaceable midsection with a front side, peripheral sides, and five (5) core receivers.

FIG. 20 is a front perspective view of the replaceable midsection 522 formed with one (1) or more core receivers 508. The core receiver 508 is a continuous cutout or tunnel that extends from the front side 526 of the replaceable midsection 522 to the back side 530 of the replaceable midsection 522. The core receivers 508 are configured to receive one or more replaceable cube cores 110 as described above. As with previous embodiments described above, the shape of the core receiver 508 corresponds with the shape of the replaceable cube cores 110. Thus, the shape of the replaceable cube cores 110 is dependent on the size and shape of the core receivers 508 and vice versa.

In addition, although five (5) core receivers 508 are shown in FIG. 20, it will be understood by those skilled in the art, that one (1) or more core receivers 508 may be used and may be located at any location on the base 502 of Archery Target 500 and in any pattern, depending on the desires of the user.

In this embodiment, the replaceable cube cores 110 can be rotated within the core receiver 508 as described above. Furthermore, as the user shoots at the Archery Target 500 with arrows, the replaceable midsection 522 will become used from being hit with stray arrows. In order to present the user with a fresh target surface and surrounding area, the user may replace the replaceable midsection 522 without needing to replace the target frames 504. Since the target frames 504 represents an area of the Archery Target 500 that is least likely to be hit by stray arrows, this embodiment allows the user to replace the replaceable midsection 522 without having to replace the target frames 504.

Figure 21:
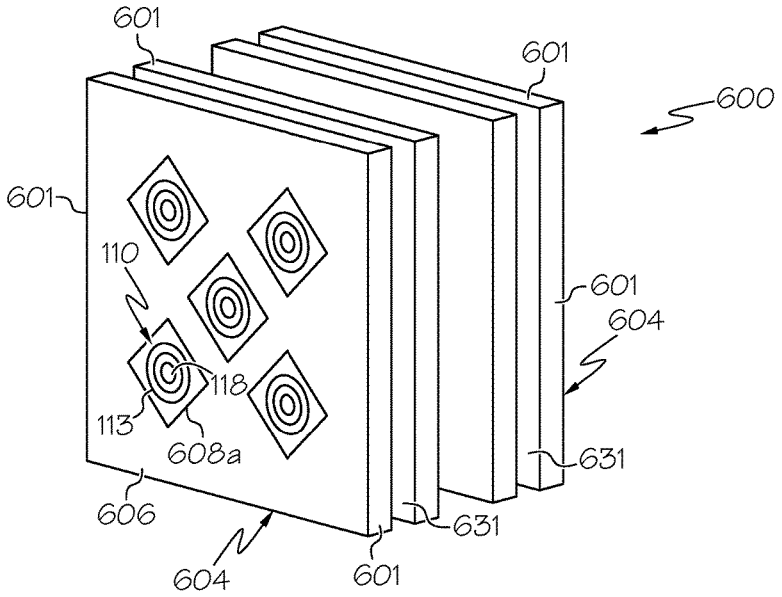
FIG. 21 is a front perspective view of an alternative embodiment of the Stackable Archery Target Having Replaceable Cube Cores of the present invention, showing the replaceable cube cores and base with grooves formed into the peripheral sides of each replaceable panel.

In FIG. 21, an alternative embodiment of the Archery Target Having Multiple Replaceable Cube Cores is shown and generally designated 600 (hereafter referred to as "Archery Target 600"). As with the previous embodiment (Archery Target 400, shown in FIG. 11), the Archery Target 600 includes a base 602 formed to receive one or more replaceable cube cores 110. The replaceable cube cores 110 are depicted in FIG. 11 showing target face one 113 with the visual target display 118. The base 602 has two (2) replaceable panels 604 and a base midsection 622.

The Archery Target 600 shown in FIG. 21 is identical to the Archery Target 400 shown in FIG. 11, with the addition of the following feature:

The four (4) peripheral sides 601 of the each of the replaceable panels 604 of Archery Target 600 is formed with a groove 631. The grooves 631 can vary in depth and width depending on the desires of the user. The purpose of the grooves 631 is to allow the user to secure the Archery Targets 600 when multiple Archery Targets 600 are positioned next to or on top of, one another.

Figure 22:
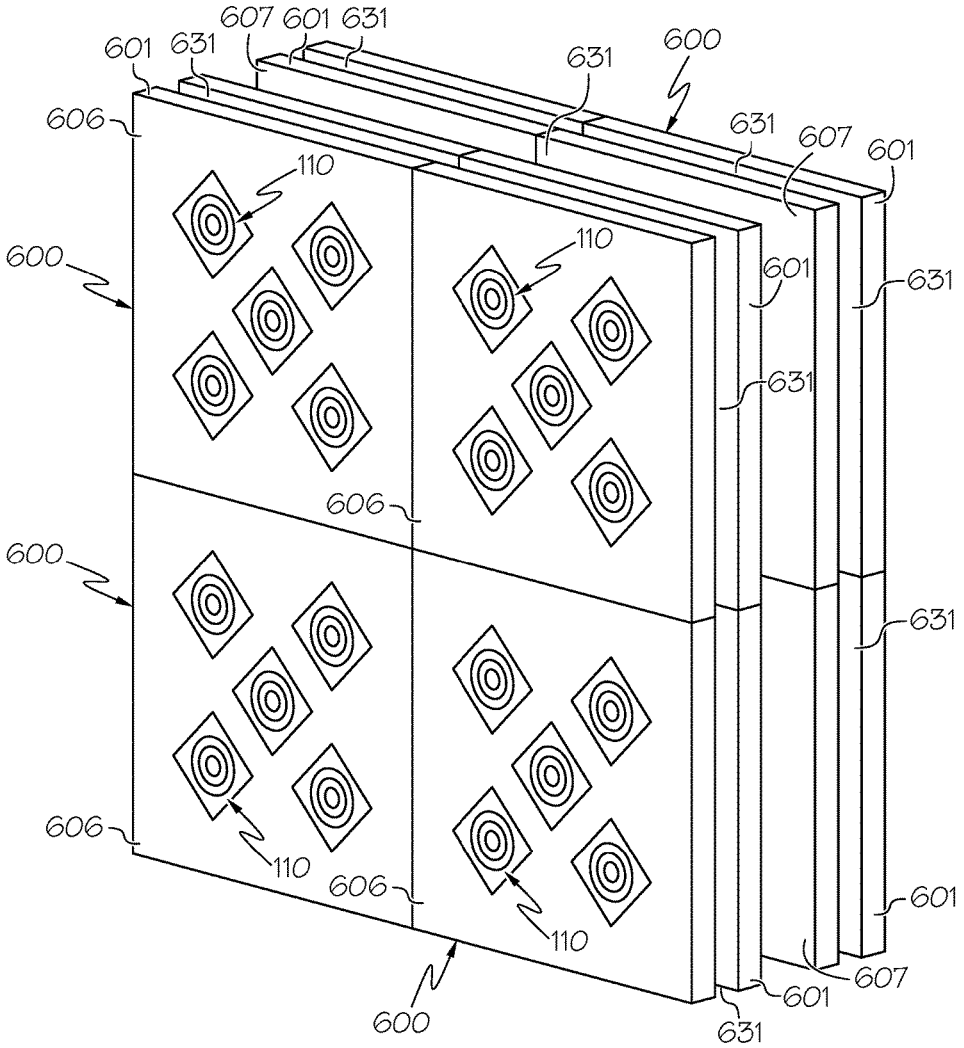
FIG. 22 is a front perspective view of four (4) alternative embodiments of the Stackable Archery Target Having Replaceable Cube Cores of the present invention, stacked upon and placed next to one another.

As with the all the previous embodiments, the Archery Target 600 can be stacked on, and next to, one another to create a larger structure of Archery Targets 600, as shown in FIG. 22. When two (2) or more Archery Targets 600 are connected to one another, it may be difficult to prevent the Archery Target 600 from moving away from one another when struck with an arrow. Thus, the grooves 631 allows the user to place a rope, ribbon, string, chain, or other securing means around the peripheral sides 601 of each of the of multiple Archery Targets 600, by positioning the rope, ribbon, string, chain, or other securing means within the groves 631; effectively securing the Archery Targets 600 to one another.

While the Archery Target 600 is described as identical to Archery Target 400, but with added grooves 631 formed into the peripheral sides 601 of each of the replaceable panels 604, it is to be understood by those skilled in the art that Archery Target 500 may also be formed with grooves 631 as described for Archery Target 600 along the peripheral sides 501 of the target frames 504, without deviating from the scope and spirit of the invention.

While there have been shown what are presently considered to be preferred and alternative embodiments of the present invention, it will be apparent to those skilled in the art that various changes and modifications can be made herein without departing from the scope and spirit of the invention.

What is claimed is:

1. An archery target comprising:

a geometrically shaped target frame formed with a plurality of core receivers, each core receiver extending from a front side of the target frame to a back side of the target frame and presenting a target on both the front side and back side of the target frame; and a plurality of geometrically shaped replaceable cores receivable into each core receiver, and wherein the plurality of geometrically shaped replaceable cores is comprised of three replaceable cores, each replaceable core having three or more target faces, and wherein each replaceable core can be rotated and moved within the core receiver to place a different target face on either the front side of the target frame or the back side of the target frame.

2. The archery target of claim 1, wherein the target frame is cube shaped and each replaceable core is cube shaped.

3. The archery target of claim 1, wherein the target frame is rectangular shaped and each replaceable core is rectangular shaped.

4. The archery target of claim 1, wherein each replaceable core has a plurality of sides, and each side has a visual target display.

5. The archery target of claim 1, wherein the replaceable cores are formed of a high density, self-sealing polyurethane foam material.

6. The archery target of claim 2 wherein the plurality of core receivers is five core receivers.

* * * * *